US007022048B1

(12) United States Patent
Fernandez et al.

(10) Patent No.: US 7,022,048 B1
(45) Date of Patent: Apr. 4, 2006

(54) VIDEO FITNESS MACHINE

(76) Inventors: John Fernandez, 11 Drake Ave., Bellport, NY (US) 11713; Juan Fernandez, 11 Drake Ave., Bellport, NY (US) 11713

( * ) Notice: Subject to any disclaimer, the term of this patent is extended or adjusted under 35 U.S.C. 154(b) by 0 days.

(21) Appl. No.: 10/898,914

(22) Filed: Jul. 26, 2004

(51) Int. Cl.
*A63B 21/00* (2006.01)

(52) U.S. Cl. ..... 482/8; 482/51; 482/54; 482/900

(58) Field of Classification Search ..... 482/1–9, 482/51, 54, 900–902
See application file for complete search history.

(56) References Cited

U.S. PATENT DOCUMENTS

| | | | | |
|---|---|---|---|---|
| 4,298,893 | A | 11/1981 | Holmes | |
| 4,358,105 | A | 11/1982 | Sweeney, Jr. | |
| 5,462,503 | A | 10/1995 | Benjamin et al. | |
| 5,466,200 | A | 11/1995 | Ulrich et al. | |
| 5,489,249 | A | 2/1996 | Brewer et al. | |
| 5,591,104 | A | 1/1997 | Andrus et al. | |
| 5,645,513 | A | 7/1997 | Haydocy et al. | |
| 5,690,582 | A | 11/1997 | Ulrich et al. | |
| 5,785,630 | A | 7/1998 | Bobick et al. | |
| 5,813,864 | A * | 9/1998 | Ikuta | 434/253 |
| 5,890,995 | A * | 4/1999 | Bobick et al. | 482/4 |
| 6,004,243 | A | 12/1999 | Ewert | |
| 6,244,988 | B1 | 6/2001 | Delman | |
| 6,312,363 | B1 | 11/2001 | Watterson et al. | |
| 6,413,191 | B1 | 7/2002 | Harris et al. | |
| 6,447,424 | B1 * | 9/2002 | Ashby et al. | 482/8 |

* cited by examiner

*Primary Examiner*—Glenn E. Richman
(74) *Attorney, Agent, or Firm*—Michael I. Kroll

(57) ABSTRACT

A fitness apparatus for providing a cardiovascular workout to a user is disclosed. The fitness apparatus includes a video display apparatus for selectively displaying video data thereon. A processor is connected to the cardiovascular workout means and the video display apparatus and a storage device connected to the processor for storing said video data thereon. The video data represents at least one exercise course and the processor retrieves the video data from the storage device and directs the video data to be displayed on the video display apparatus while the user uses the cardiovascular workout means.

5 Claims, 9 Drawing Sheets

VIDEO FITNESS MACHINE

BACKGROUND OF THE INVENTION

1. Field of the Invention

The present invention relates generally to fitness equipment, and more specifically, to an exercise apparatus that includes a display screen for displaying video data thereon. The apparatus is preferably an exercise bike or any type of cardiovascular equipment, such as, Elliptical, Step Up, Climbing Machine, Rowing Machine, Treadmill, etc, wherein a pre-stored riding course is displayed on the display as the rider exercises. The apparatus is calibrated so that the resistance provided to the user is substantially similar to the resistance a rider would experience on the actual course. The apparatus provides an interactive workout routine that engages the rider throughout the duration of the exercise session.

2. Description of the Prior Art

Numerous other fitness machines exist in the prior art. Typical of these are U.S. Pat. Nos. 4,298,893; 4,358,105; 5,462,503; 5,466,200; 5,489,249; 5,591,104; 5,645,513; 5,690,582; 5,785,630; 5,890,995; 6,004,243; 6,244,988; 6,312,363; 6,413,191 and Canadian Patent No. 1,160,373. While these fitness machines may be suitable for the purposes for which they were designed, they would not be as suitable for the purposes of the present invention, as hereinafter described.

A television set is energized by electricity generated by an exercise cycle. The bicycle may be used to charge a battery which in turn operates the T.V. set or the exercise cycle can turn a generator which directly operates the set. The device is particularly useful in limiting the amount of "junk" T.V. watched by children.

A control console is associated with a video input device and an exercise machine that has a movable member such as an endless belt on a powered treadmill or the pedals of an exercise cycle. Adjustment structures receiving signals from a videotape are associated to regulate the speed of the belt of the treadmill and the resistance to the movement of the pedals of the exercise cycle, respectively. The control console receives variable input in selected time segments from the audio track of the videotape to regulate and control the adjustment structure such as the motor controller of the treadmill or a resistance strap associated with the inertia wheel of the exercise cycle. Input is received from the audio channel of the video tape to select, modify or create exercise programs in the control console for operation of the related exercise machine. Video scenes from the video tape are displayed on a television. Images reflective of the movement and operation of the moveable member are also selectively displayed on the television.

An interactive exercise apparatus engages a user's mind and body. The apparatus comprises an exercise mechanism, a steering mechanism, and a control mechanism for manipulation by the user to achieve exercise, to indicate a direction of motion, and to interact with virtual objects in a simulated environment. The exercise mechanism can be, for example, the steps of a stair climbing simulator or the pedals of a bicycle, preferably a recumbent bicycle. A simulated environment (e.g., an interactive simulated three-dimensional environment or an interactive simulated three-dimensional fluid environment) is generated by a computer and displayed on a display system for the user. In one embodiment, the simulated environment comprises an enclosed space representing a game field. In this embodiment, an interactive competitive ball game is played using networked exercise apparatus. The user manipulates the exercise mechanism, the steering mechanism, and the control mechanism to travel throughout the game field and interact with virtual objects to score points. The computer controls the exercise mechanism and monitors the exercise mechanism, the steering mechanism, and the control mechanism to determine user position and the position of virtual objects in the simulated environment. The display provides a visual display of the user's position and the position of virtual objects in the simulated environment. A plurality of the interactive exercise apparatus can be networked together to allow group participation and competition in the simulated game.

The present invention is directed to systems and methods for providing exercise devices with motivational programming. The present invention is particularly well suited to exercise devices that utilize one or more motors and/or other electrically driven actuators to control one or more operating parameters of the exercise device. The present invention contemplates the use of programming that includes motivational content and one or more control signals, synchronized with the motivational content, for controlling operation of the exercise device. The motivational content preferably includes audio and/or video designed to simulate a group exercise setting. In addition, the motivational content can include instructional and educational content for the benefit of the user. The programming can be live or prerecorded and can be broadcast over available broadcast channels, cable, satellite, the internet or anything suitable for transmitting audio and/or video signals. Alternatively, the programming can be prerecorded and stored on a storage medium, such as audio cassette tapes, compact discs, mini-discs, videotapes, laser discs, digital video discs, computer diskettes or any other storage medium suitable for the storage and reproduction of audio and/or video signals. The present invention also includes reproducing the programming, including the motivational content along with the synchronized control signals. Finally, the present invention includes decoding the control signals and for controlling the operation of the exercise device in synchronization with the motivational content.

An interactive exercise apparatus engages a user's mind and body. The apparatus comprises an exercise mechanism, a steering mechanism, and a control mechanism for manipulation by the user to achieve exercise, to indicate a direction of motion, and to interact with virtual objects in a simulated environment. The exercise mechanism can be, for example, the steps of a stair climbing simulator or the pedals of a bicycle, preferably a recumbent bicycle. A simulated environment (e.g., an interactive simulated three-dimensional environment or an interactive simulated three-dimensional fluid environment) is generated by a computer and displayed on a display system for the user. In one embodiment, the simulated environment comprises an enclosed space representing a game field. In this embodiment, an interactive competitive ball game is played using networked exercise apparatus. The user manipulates the exercise mechanism, the steering mechanism, and the control mechanism to travel throughout the game field and interact with virtual objects to score points. The computer controls the exercise mechanism and monitors the exercise mechanism, the steering mechanism, and the control mechanism to determine user position and the position of virtual objects in the simulated environment. The display provides a visual display of the user's position and the position of virtual objects in the simulated environment. A plurality of the interactive exercise apparatus can be networked together to allow group participation and competition in the simulated game.

A piece of exercise equipment includes an electronic game of chance connected thereto. A switch or other device may also be connected to the combination system to operate the electronic game of change when the piece of exercise equipment is in use. The combination system also includes a controller which detects a combined action of playing the electronic game of chance and using the exercise equipment. The system electronically connects the gambling device to the piece of exercise equipment and detects when an operator is using both the exercise equipment and the electronic game of chance simultaneously.

An interactive exercise apparatus engages a user's mind and body. The apparatus comprises a support structure for supporting a user. An exercise mechanism and a steering mechanism are proximal to the support structure. A simulated environment is generated by a computer and displayed on a display system. The user manipulates the exercise mechanism and the steering mechanism to freely navigate through the simulated environment. The computer monitors the exercise mechanism and the steering mechanism to determine user position in the simulated environment. The display is periodically updated by the computer to provide a continuous visual display of the user's position as the user travels through the simulated environment.

An exercise apparatus combined with a video game computer that allows the exerciser to interactively participate in the video game whereby the exerciser's advancement in the video game depends on his rate of exercise and hand-eye coordination. The exercise apparatus provides entertainment and a positive mental distraction from the boring physical exercising experience by enabling multi-sensor feedback between the user and video game simulation. This exercise apparatus has the ability to interface with any exercise device that the user prefers and it will also work with non-equipment exercising methods.

A system, apparatus and method for interactively controlling the rate of real-time video playback and audio track playback is disclosed. A preferred embodiment of the apparatus is an interactive exercise video system which utilizes a bicycle, a bicycle wheel speed detector, an interface unit connected to the wheel speed detector and to a conventional game controller connected to a conventional video game CD player, which is in turn connected to a TV. A prerecorded video CD is played in the player in which the display rate of video images is altered via software embedded on the CD such that the speed of the video is changed by the level of activity on the exercise device. The variation of the video frame rate is accomplished by modifying the duration time stamp on each video frame which is used by the player control program so as to change the sequential time at which each frame is called for display by the conventional video player. The variation of video display rate is independent of the pitch of the audio play rate. To maintain synchronization of the audio with the video without changing the pitch of the audio, portions of the audio are looped back, i.e. replayed.

An interactive exercise apparatus engages a user's mind and body. The apparatus comprises an exercise mechanism and a steering mechanism for manipulation by the user to achieve exercise and to indicate a direction of motion. A simulated environment is generated by a computer and displayed on a display system for the user. The user manipulates the exercise mechanism and the steering mechanism to freely navigate through the simulated environment. The computer monitors the exercise mechanism and the steering mechanism to determine user position in the simulated environment. The display is periodically updated by the computer to provide a continuous visual display of the user's position as the user travels through the simulated environment. A plurality of the interactive exercise apparatus can be networked together to allow group participation in the simulated environment.

An interactive exercise apparatus engages a user's mind and body. The apparatus comprises an exercise mechanism and a steering mechanism for manipulation by the user to achieve exercise and to indicate a direction of motion. The exercise mechanism can be, for example, the steps of a stair climbing simulator or the pedals of a bicycle, preferably a recumbent bicycle. A simulated environment (e.g., an interactive simulated three-dimensional environment or an interactive simulated three-dimensional fluid environment) is generated by a computer and displayed on a display system for the user. The user manipulates. the exercise mechanism and the steering mechanism to travel substantially unrestricted throughout the simulated environment. The computer controls the exercise mechanism and monitors the exercise mechanism and the steering mechanism to determine user position in the simulated environment. The display provides a visual display of the user's position in the simulated environment. A plurality of the interactive exercise apparatus can be networked together to allow group participation in the simulated environment.

An improved interactive exercise system is disclosed. A simplified device for connecting fitness equipment such as an exercise bicycle to a computer is equipped with a game control device (e.g. industry standard computers equipped with a joystick or game port adapter). The invention also includes a self-contained exercise device. The act of exercising is converted into signals by a sensor which are then counted by the software and used to control an audio-visual display in such a way that pedaling speed can control the speed of what is been viewed. Hand operated switches allow the user to chose directions when the display indicates the user has come to a turning point. Various exercise parameters and progress towards goals are shown in a window on the display. Parameters and exercise data can be stored, reviewed, and used during other sessions. When used as an interactive exercise touring system, the user can literally pedal his way around the world, through the universe, or even through the human body, seeing the sights on the display screen and listening to a narrator describe what is being seen. By depressing the appropriate touch switches, the user can retrieve more information about a particular area and has the ability to pause the presentation at any time independent of the exercise activity. The device is linkable to other devices so that multiple users can tour a place together or compete against each other.

An exerciser is disclosed, of the type providing automatically controlled variations of effort levels, wherein "random" variations of effort level are included which are not predictable by the operator. The effort levels [steps] are provided in a sequence of four: the second [step] level is random; the fourth [step] level is different from the second [step value] level by half of the range; and the first and third [steps] levels are averages of the immediately preceding and immediately following [steps] levels.

A physical exercise video system includes a physical exercise machine (22), a video system (24) and an interface module (26). The video system (24) has a computer (28) and a removable cartridge (34). The interface module (26) is interposed between the computer (28) and cartridge (34), and provides interactive communication between the computer (28) and exercise machine (22). A communication protocol governs this communication, and includes specifications for status and command data packets. The video system (24) and exercise machine (22) can be selectively operated as either stand-alone units, or in an interactive exercise mode, wherein the exercise data generated by the exercise machine (22) affects the output of the video system (24), and may also be stored in memory within the interface module (26). The video system (24) controls the operation of the exercise machine (22) generally, and specifically, controls the load resistance imposed in opposition to the movement of pedals (66). The control of load resistance by video system (24) is a function of the operating characteristics of the exercise machine (22).

A device for translating exercise movement form a mechanical repetitive exercise means into the motion of a marker on a television screen. The device comprises a frequency monitoring means to be associated with a mechanical repetitive exercise means to convert the frequency of repetition of the exercise means into electronic pulses of related frequency. An electronic control means is provided to be electronically connected to receive input from the frequency monitoring means and to be electronically associated with a video screen.

The electronic control means comprises input scanning means to scan input pulses received from the frequency monitoring means, and microprocessor electronically associated with the input scanning means and, when operational, a video screen to translate frequency of pulses to a corresponding rate of motion for the marker on the video screen. The device preferably further comprises a turn control means manually actuable by the operator to provide electronic control means to translate such signals into corresponding direction of motion for the marker on the video screen. The electronic control means may also comprise memory means electronically associated with the microprocessor for storing one or more basic game patterns according to which the motion of the marker will be affected. Such device permits one or more operators of mechanical repetitive exercise means to coordinate the motion of one or more corresponding markers on a video screen with the operation of that exercise means.

SUMMARY OF THE PRESENT INVENTION

The present invention relates generally to fitness equipment, and more specifically, to an exercise apparatus that includes a display screen for displaying video data thereon. The apparatus is preferably an exercise bike wherein a pre-stored riding course is displayed on the display as the rider exercises. The apparatus is calibrated so that the resistance provided to the user is substantially similar to the resistance a rider would experience on the actual course. The apparatus provides an interactive workout routine that engages the rider throughout the duration of the exercise session.

A primary object of the present invention is to provide a video fitness apparatus that overcomes the shortcomings of the prior art.

Another object of the present invention is to provide a video fitness apparatus that is formed as an exercise cycle.

Still another object of the present invention is to provide a video fitness apparatus wherein the exercise cycle has a display screen connected thereto.

Still another object of the present invention is to provide a video fitness apparatus wherein the display screen selectively displays stored video data representing a cycling course.

Yet another object of the present invention is to provide a video fitness apparatus wherein the rider can selectively determine which cycling course will be displayed on the display screen for viewing thereof.

Still yet another object of the present invention is to provide a video fitness apparatus that selectively provides resistance to a rider throughout the exercise routine.

A further object of the present invention is to provide a video fitness apparatus wherein the resistance provided is substantially equal to the pitch of the displayed course.

Another object of the present invention is to provide a video fitness apparatus wherein the stored courses are well known courses located throughout the world.

Yet another object of the present invention is to provide a video fitness apparatus for providing an interactive exercise experience.

Still another object of the present invention is to provide a video fitness apparatus wherein the exercise cycle is formed as a traditional bicycle.

Another object of the present invention is to provide a video fitness apparatus wherein the exercise cycle is formed as a seated cycle.

An even further object of the present invention is to provide a video fitness apparatus wherein the display screen is a touch-sensitive display.

Yet a further object of the present invention is to provide a video fitness apparatus wherein the user selectively choose a pre-stored course and experience level.

Another object of the present invention is to provide a video fitness apparatus wherein the user can selectively input vital statistics for tracking and evaluation thereof.

Yet another object of the present invention is to provide a video fitness apparatus device that is simple and easy to use.

Still yet another object of the present invention is to provide a video fitness apparatus device that is inexpensive to manufacture and operate.

Additional objects of the present invention will appear as the description proceeds.

The foregoing and other objects and advantages will appear from the description to follow. In the description reference is made to the accompanying drawing, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawing, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

DESCRIPTION OF THE REFERENCED NUMERALS

Figure 1:
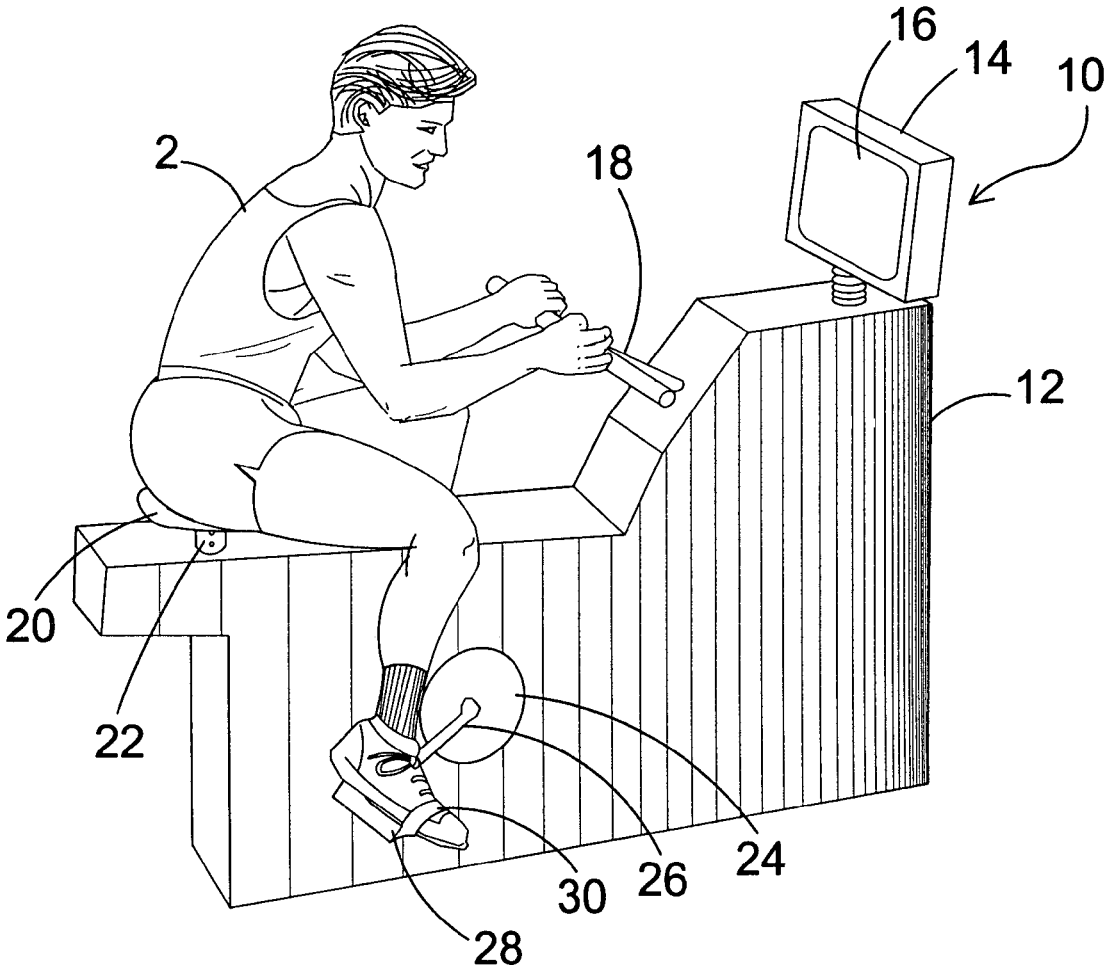
FIG. 1 is a perspective view of the video fitness apparatus of the present invention.

Turning now descriptively to the drawings, in which similar reference characters denote similar elements throughout the several views, the Figures illustrate the video fitness apparatus of the present invention. With regard to the reference numerals used, the following numbering is used throughout the various drawing Figures.

2 user/rider
10 video fitness apparatus of the present invention
12 cycle body
14 monitor
16 screen
17 monitor leg
18 handle bar
20 seat
22 seat extension
24 pedal mechanism
26 pedal extension
28 pedal block
30 strap
32 seat
34 handles
35 mount
36 hinge
38 directional arrow
40 processor
42 storage device
44 ROM
46 resistance control device

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments. Practitioners skilled in the art will recognize numerous other embodiments as well. For definition of the complete scope of the invention, the reader is directed to appended claims.

Turning now descriptively to the drawings, in which similar reference characters denote similar elements throughout the several views, FIGS. 1 through 9 illustrate a video fitness apparatus of the present invention indicated generally by the numeral 10.

FIG. 1 is a perspective view of the video fitness apparatus of the present invention. The video fitness apparatus 10 of the present invention is a device that provides entertainment to a user who is engaging in cardiovascular exercise. As shown herein, the apparatus 10 of the present invention is formed as an exercise cycle. However, as shown and discussed herein after with specific reference to FIG. 9, the video fitness device may be formed as any device allowing a user to engage in cardiovascular exercise.

The video fitness apparatus 10 includes a cycle body 12 having a monitor 14 positioned a first end thereof. The monitor 14 includes a screen 16 for displaying video data thereon. Positioned at an end of the cycle body 12 opposite from the monitor 14 is a seat 20. The seat 20 is connected to the cycle body 12 via an extender bar 22. The extender bar 22 allows for selective adjustment of the height of the seat 20 from the cycle body 12. A handlebar 18 extends from the cycle body 12 at substantially a midpoint thereof. The cycle body 12 also includes the pedal mechanism 24 having pedal extensions 6 extending therefrom. As shown in FIG. 1, only a single pedal extension 26 is visible, but there is a matching pedal extension on the opposite side thereof. At the end of the pedal extension 26 opposite the connection of with the cycle body 12 is a pedal block 28 a strap 30 for retaining a users feet therein.

As shown, a top side of the cycle body from which the seat 20, handlebar 18 and the monitor 14 extend upwardly therefrom has two substantially flat section parallel to one another and connected by an angled section. The seat 20 is positioned on the first lower flat section and the monitor 14 extends up from the second higher flat section. The handlebar 18 is positioned on the angled section connecting the lower and higher flat portions. This configuration is advantageous in that, as shown in FIG. 1, a user 2 sitting on the seat 20 and holding onto the handlebar 18 is substantially eye level with the monitor 14 positioned on the second higher flat section of the cycle body 12. This alleviates unwanted stress on the user's neck as well as provides a more realistic feeling when cycling and viewing the video data on the monitor 14.

As will be discussed hereinafter, the video data displayed on the screen 16 of the monitor 14 represents video of known cycling courses throughout the world. The user 2 is able to selectively determine which course he/she would like to view while exercising. Further, the video fitness apparatus will interactively respond with the video being displayed by selectively increasing and decreasing resistance of the pedal mechanism 24. This interaction allows the user to truly feel that they are actually riding on the course being displayed on the screen 16 of the monitor 14.

Figure 2:
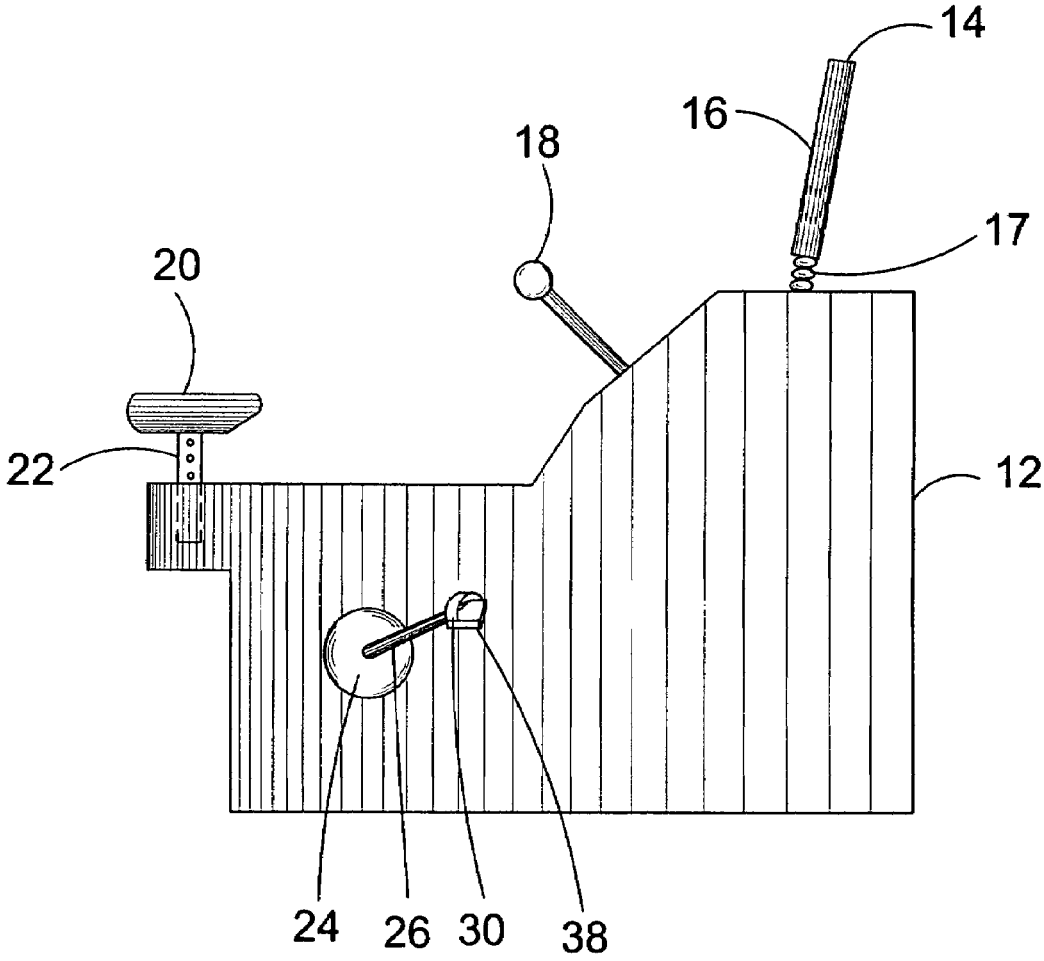
FIG. 2 is a side view of the video fitness apparatus of the present invention.

FIG. 2 is a side view of the video fitness apparatus of the present invention. The video fitness apparatus 10 includes the cycle body 12 having the monitor 14 positioned the first end thereof. The monitor 14 includes the screen 16 for displaying video data thereon. Positioned at an end of the cycle body 12 opposite from the monitor 14 is the seat 20. The seat 20 is connected to the cycle body 12 via the extender bar 22. The extender bar 22 allows for selective adjustment of the height of the seat 20 from the cycle body 12. The handlebar 18 extends from the cycle body 12 at substantially a midpoint thereof. The cycle body 12 also includes the pedal mechanism 24 having pedal extensions 26 extending therefrom. As shown in FIG. 2, only a single pedal extension 26 is visible, but there is a matching pedal extension on the opposite side thereof. At the end of the pedal extension 26 opposite the connection of with the cycle body 12 is the pedal block 28 the strap 30 for retaining a users feet thereon.

As shown, a top side of the cycle body from which the seat 20, handlebar 18 and the monitor 14 extend upwardly therefrom has two substantially flat section parallel to one another and connected by an angled section. The seat 20 is positioned on the first lower flat section and the monitor 14 extends up from the second higher flat section. The handlebar 18 is positioned on the angled section connecting the lower and higher flat portions. This configuration is advantageous in that, as shown in FIG. 1, a user 2 sitting on the seat 20 and holding onto the handlebar 18 is substantially eye level with the monitor 14 positioned on the second higher flat section of the cycle body 12. This alleviates unwanted stress on the user's neck as well as provides a more realistic feeling when cycling and viewing the video data on the monitor 14.

The video data displayed on the screen 16 of the monitor 14 represents video of known cycling courses throughout the world. The user 2 is able to selectively determine which course he/she would like to view while exercising. Further, the video fitness apparatus will interactively respond with the video being displayed by selectively increasing and decreasing resistance of the pedal mechanism 24. This interaction allows the user to truly feel that they are actually riding on the course being displayed on the screen 16 of the monitor 14.

The monitor 14 as shown in FIG. 2 is connected to the body 12 by a moveable arm 17. The arm 17 is selectively pivotable thereby allowing the monitor 14 to be moved in a direction either towards or away from the user seated on the seat 20. This is a measure to fully ensure the comfort of the user using the apparatus 10 of the present invention.

Figure 3:
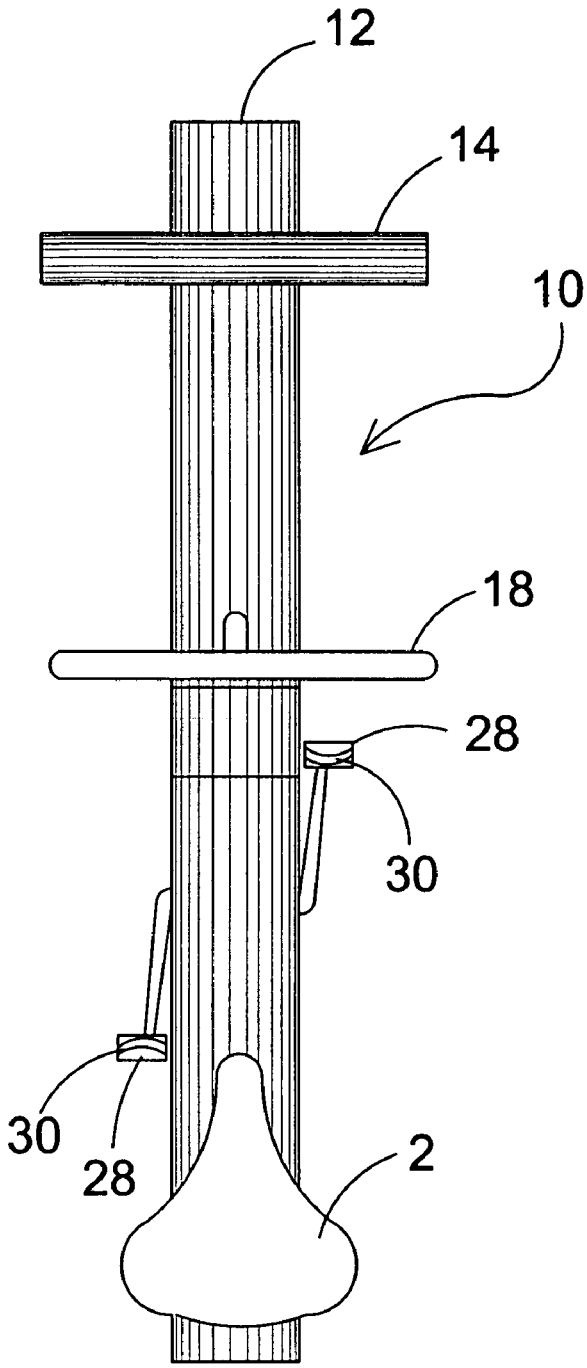
FIG. 3 is a top view of the video fitness apparatus of the present invention.

FIG. 3 is a top view of the video fitness apparatus of the present invention. The video fitness apparatus 10 includes the cycle body 12 having the monitor 14 positioned the first end thereof. The monitor 14 includes the screen 16 for displaying video data thereon. Positioned at an end of the cycle body 12 opposite from the monitor 14 is the seat 20. The seat 20 is connected to the cycle body 12 via the extender bar 22. The extender bar 22 allows for selective adjustment of the height of the seat 20 from the cycle body 12. The handlebar 18 extends from the cycle body 12 at substantially a midpoint thereof. The cycle body 12 also includes the pedal mechanism 24 having pedal extensions 26 extending therefrom. Both single pedal extensions 26 are visible in this top view of the apparatus 10 of the present invention. At the end of the pedal extension 26 opposite the connection of with the cycle body 12 is the pedal block 28 the strap 30 for retaining a users feet thereon.

As shown, a top side of the cycle body from which the seat 20, handlebar 18 and the monitor 14 extend upwardly therefrom has two substantially flat section parallel to one another and connected by an angled section. The seat 20 is positioned on the first lower flat section and the monitor 14 extends up from the second higher flat section. The handlebar 18 is positioned on the angled section connecting the lower and higher flat portions. This configuration is advantageous in that, as shown in FIG. 1, a user 2 sitting on the seat 20 and holding onto the handlebar 18 is substantially eye level with the monitor 14 positioned on the second higher flat section of the cycle body 12. This alleviates unwanted stress on the user's neck as well as provides a more realistic feeling when cycling and viewing the video data on the monitor 14.

The video data displayed on the screen 16 of the monitor 14 represents video of known cycling courses throughout the world. The user 2 is able to selectively determine which course he/she would like to view while exercising. Further, the video fitness apparatus will interactively respond with the video being displayed by selectively increasing and decreasing resistance of the pedal mechanism 24. This interaction allows the user to truly feel that they are actually riding on the course being displayed on the screen 16 of the monitor 14.

Figure 4:
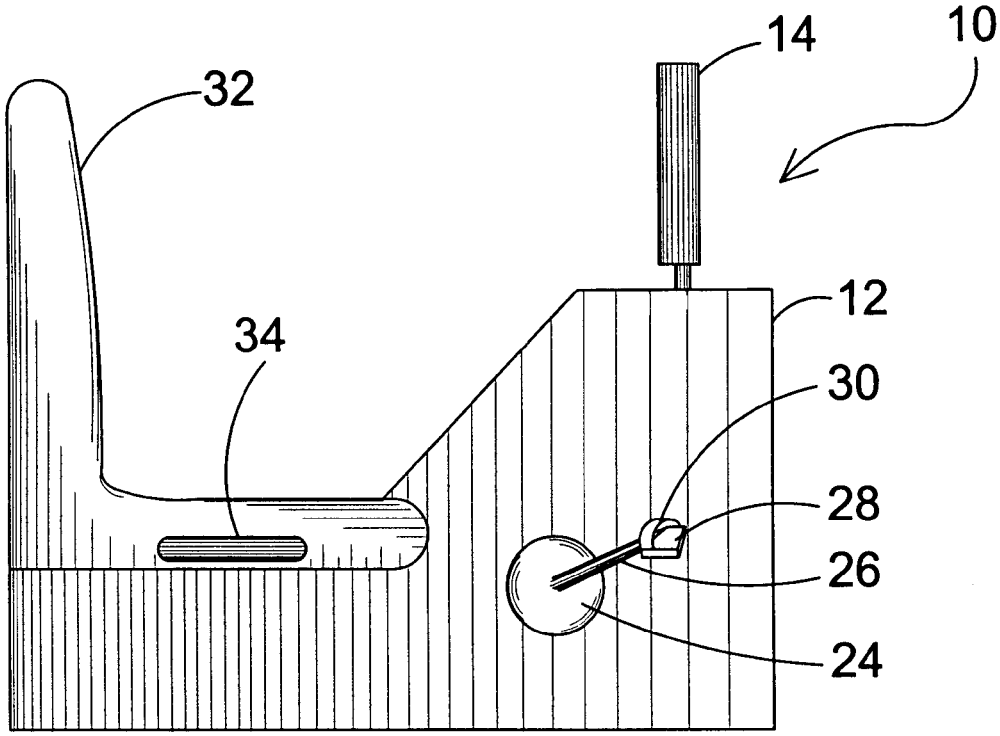
FIG. 4 is a side view of an alternate embodiment of the video fitness apparatus of the present invention.

FIG. 4 is a side view of an alternate embodiment of the video fitness apparatus of the present invention. The video fitness apparatus 10 includes the cycle body 12 having the monitor 14 positioned the first end thereof. The monitor 14 includes the screen 16 for displaying video data thereon. Positioned at an end of the cycle body 12 opposite from the monitor 14 is the seat 20. The cycle body 12 also includes the pedal mechanism 24 having pedal extensions 26 extending therefrom. As shown in FIG. 4, only a single pedal extension 26 is visible, but there is a matching pedal extension on the opposite side thereof. At the end of the pedal extension 26 opposite the connection of with the cycle body 12 is the pedal block 28 the strap 30 for retaining a users feet thereon.

The embodiment shown in FIG. 4 shows the seat 20 formed as a chair 32. The seat 20 includes grip handles 34 positioned at the base of the chair 32. The grip handles 34 allow the user to hold on without hunching forward and straining the user's back muscles.

As shown, a top side of the cycle body from which the seat 20, and the monitor 14 extend upwardly therefrom has two substantially flat section parallel to one another and connected by an angled section. The seat 20 is positioned on the first lower flat section and the monitor 14 extends up from the second higher flat section. This configuration is advantageous in that a user sitting in the seat 20 is substantially eye level with the monitor 14 positioned on the second higher flat section of the cycle body 12. This alleviates unwanted stress on the user's neck as well as provides a more realistic feeling when cycling and viewing the video data on the monitor 14.

The video data displayed on the screen 16 of the monitor 14 represents video of known cycling courses throughout the world. The user is able to selectively determine which course he/she would like to view while exercising. Further, the video fitness apparatus will interactively respond with the video being displayed by selectively increasing and decreasing resistance of the pedal mechanism 24. This interaction allows the user to truly feel that they are actually riding on the course being displayed on the screen 16 of the monitor 14.

Figure 5:
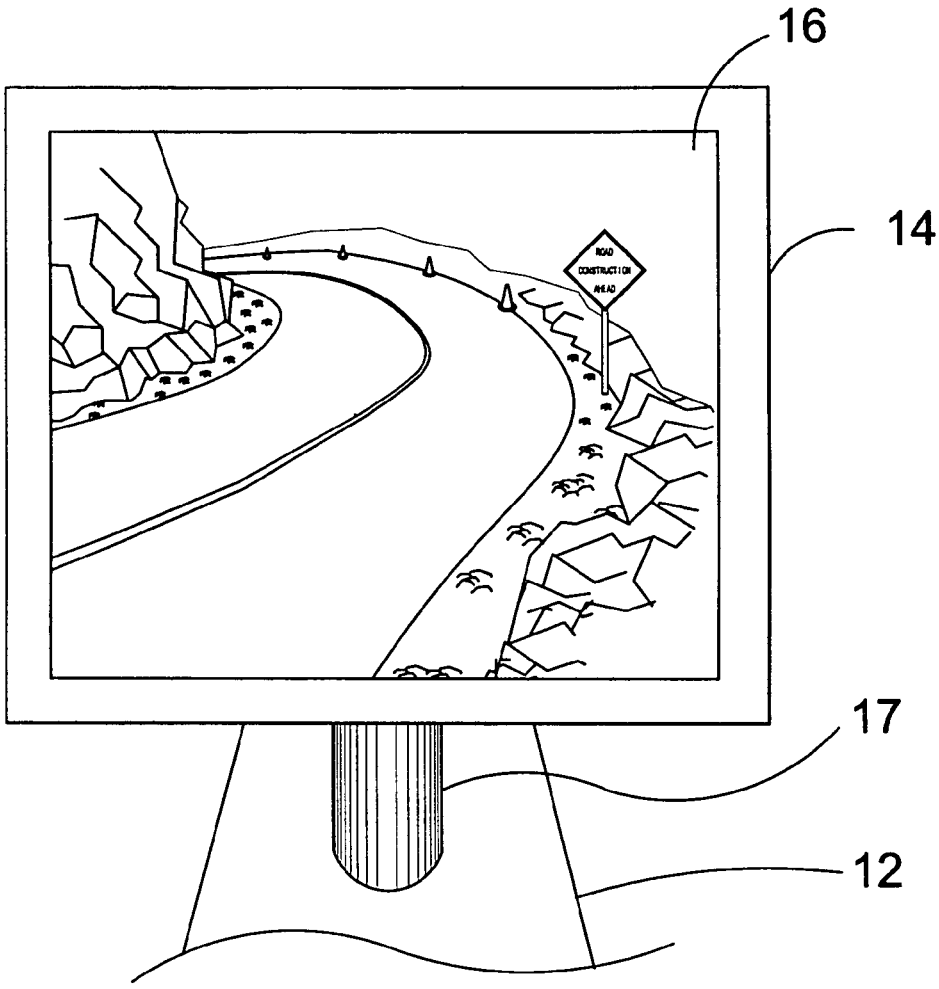
FIG. 5 is an enlarged face view of the display screen of the video fitness apparatus of the present invention.

FIG. 5 is an enlarged face view of the display screen of the video fitness apparatus of the present invention. The display screen 16 of the monitor 14 allows for pre-stored video data to be displayed thereon. Preferably the screen is at least one of an LCD screen and a plasma screen. The video data displayed on the screen represent known cycling paths throughout the world and the video scrolls along as the user pedals the pedal mechanism thereby allowing the user to feel like he/she is actually cycling on the displayed path. Additionally, the path topography is pre-stored and corresponds to the pedal mechanism 24. As the pitch and altitude of the displayed path changes, the resistance of the pedal mechanism is at least one of increased and decreased as required. This further enhances the user's workout while virtually transporting the user to the displayed path. The pre-stored known cycling paths may be video data captured on any cycling path around the world such as each individual leg of the Tour de France.

Figure 6:
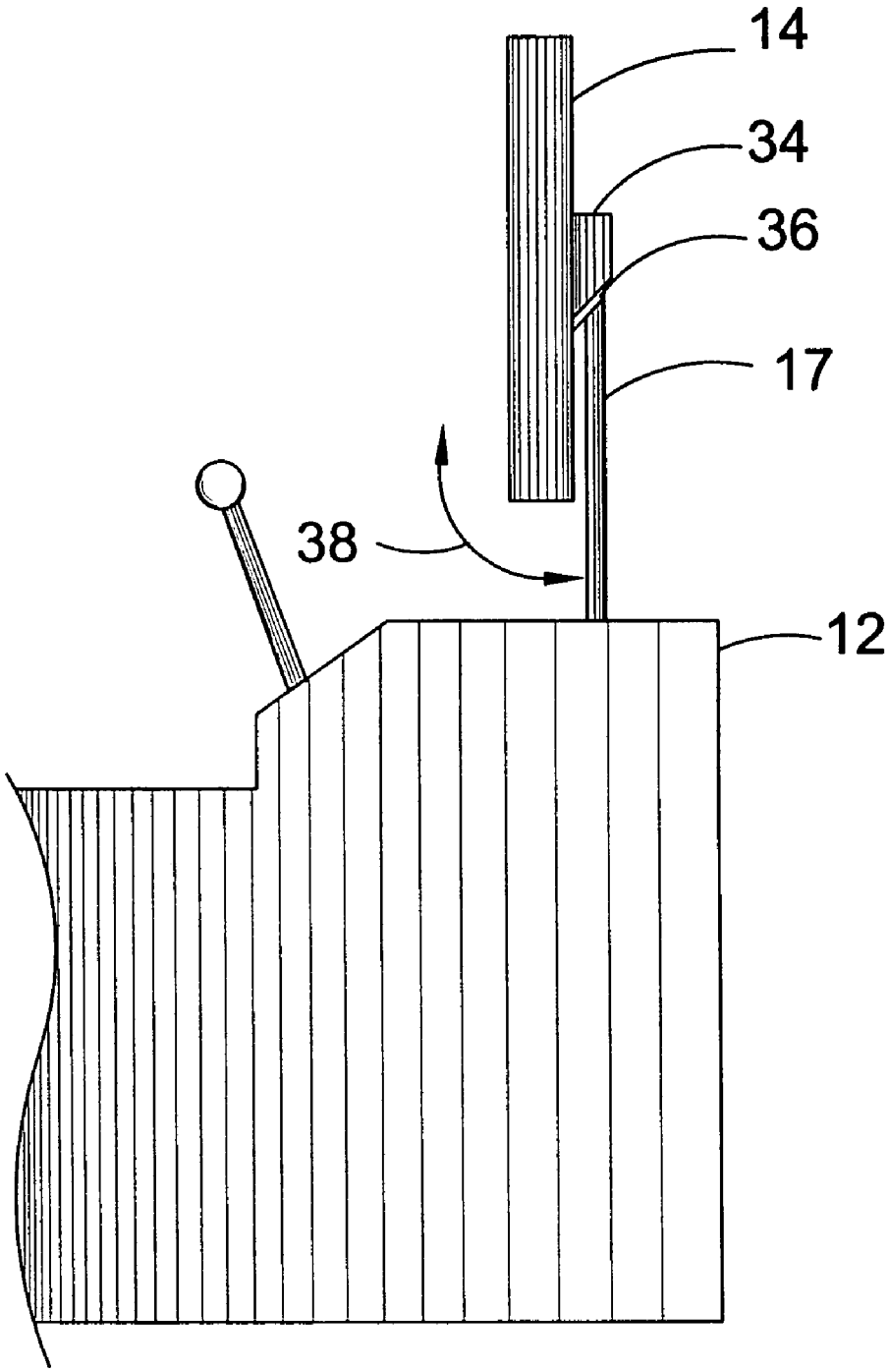
FIG. 6 is side view of the video fitness apparatus of the present invention having a selectively pivotable display.

FIG. 6 is side view of the video fitness apparatus of the present invention having a selectively pivotable display. The video fitness apparatus 10 includes the cycle body 12 having the monitor 14 positioned the first end thereof. The monitor 14 includes the screen 16 for displaying video data thereon. Positioned at an end of the cycle body 12 opposite from the monitor 14 is the seat 20. The seat 20 is connected to the cycle body 12 via the extender bar 22. The extender bar 22 allows for selective adjustment of the height of the seat 20 from the cycle body 12. The handlebar 18 extends from the cycle body 12 at substantially a midpoint thereof. The cycle body 12 also includes the pedal mechanism 24 having pedal extensions 26 extending therefrom. As shown in FIG. 2, only a single pedal extension 26 is visible, but there is a matching pedal extension on the opposite side thereof. At the end of the pedal extension 26 opposite the connection of with the cycle body 12 is the pedal block 28 the strap 30 for retaining a users feet thereon.

As shown, a top side of the cycle body from which the seat 20, handlebar 18 and the monitor 14 extend upwardly therefrom has two substantially flat section parallel to one another and connected by an angled section. The seat 20 is positioned on the first lower flat section and the monitor 14 extends up from the second higher flat section. The handlebar 18 is positioned on the angled section connecting the lower and higher flat portions. This configuration is advantageous in that, as shown in FIG. 1, a user 2 sitting on the seat 20 and holding onto the handlebar 18 is substantially eye level with the monitor 14 positioned on the second higher flat section of the cycle body 12. This alleviates unwanted stress on the user's neck as well as provides a more realistic feeling when cycling and viewing the video data on the monitor 14.

The video data displayed on the screen 16 of the monitor 14 represents video of known cycling courses throughout the world. The user 2 is able to selectively determine which course he/she would like to view while exercising. Further, the video fitness apparatus will interactively respond with the video being displayed by selectively increasing and decreasing resistance of the pedal mechanism 24. This interaction allows the user to truly feel that they are actually riding on the course being displayed on the screen 16 of the monitor 14.

The monitor 14, as shown in FIG. 6, is connected to the arm 17 by a mount 35 having a hinge 36. This configuration allows the monitor 14 to be selectively pivtoable about an axis thereby allowing the monitor to be moved in the directions indicated by the arrows labeled with reference numeral 38. This allows the user to adjust the monitor in order to reduce glare on the screen 16.

Figure 7:
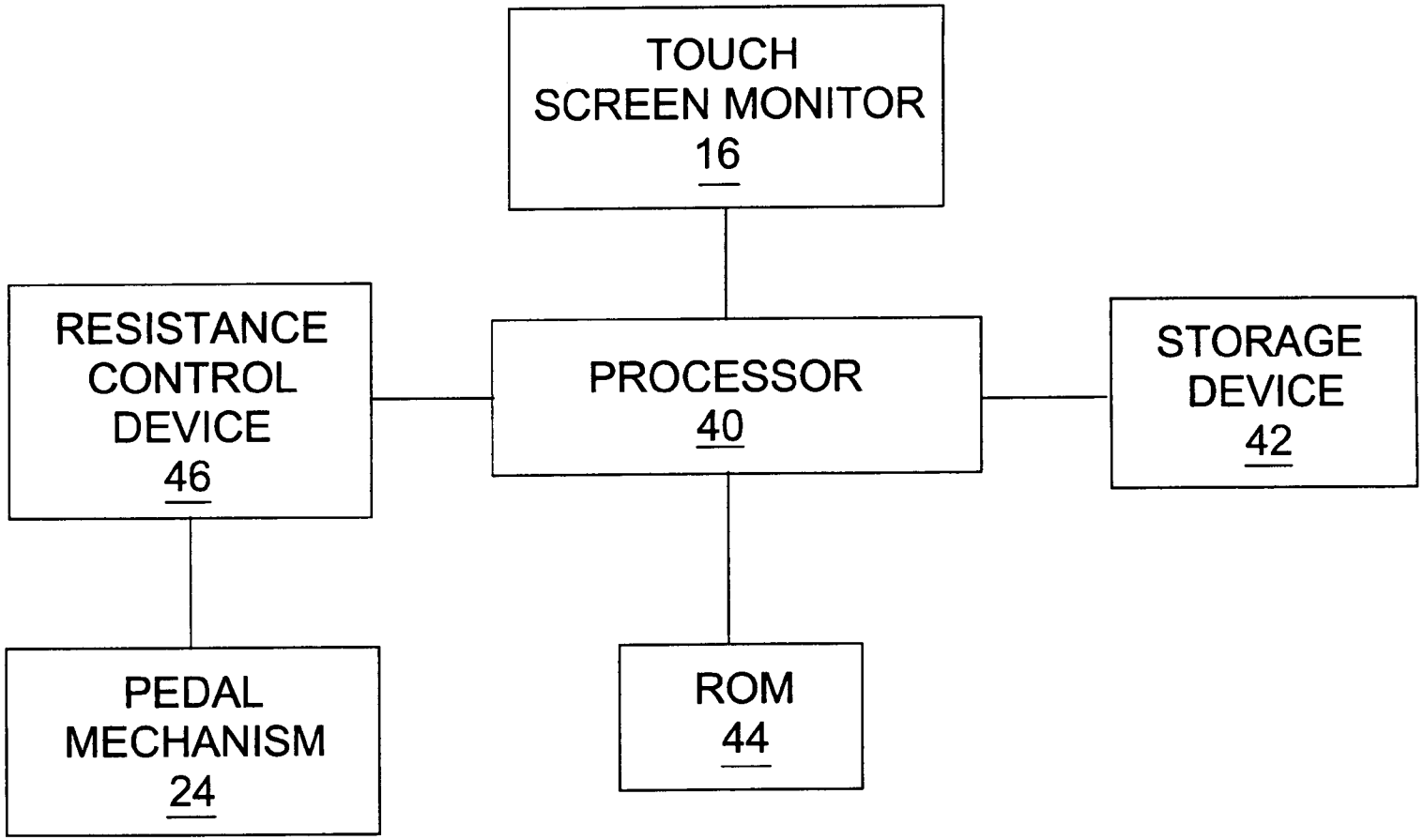
FIG. 7 is a block diagram of the video fitness apparatus of the present invention.

FIG. 7 is a block diagram of the video fitness apparatus of the present invention. The video fitness apparatus 10 is controlled by a processor 40. A ROM 44 and a storage device 42 are connected to the processor 40. Also connected to the processor 40 is the pedal mechanism 24 through a resistance control device 46. The touch screen display 16 is also connected to the processor 40.

The ROM 44 has pre-programmed workout routines and paths stored therein. These are preferably factor installed but can also be selectively updateable in order to keep up with state of the art fitness routines. The ROM 44 also includes instructions for operation of the resistance control device 48. The storage device 42 is preferably a hard disk drive having a capacity of at least 200 gigabytes for storing data representing video images of cycling courses around the world. Also stored on the storage device 42 is data representing resistance experienced by a cyclist who is cycling on a respective one of stored courses.

The touch-screen display 16 allows the user to selectively pick at least one of a workout routine and a cycling course that is stored in the storage device 42. Upon selecting a specific course, the processor directs the storage device 42 to display the data representing the cycling course on the display 16. The processor 40 simultaneously reads the resistance data stored on the storage device 42 as the video data is being displayed on display screen 16. The processor 40 applies the resistance data to the resistance control mechanism 46 which selectively increases and decreases the resistance applied to the pedal mechanism 24 to accurately reflect the known topography of the cycling course being displayed on the display 16. The ROM 44 includes a timing mechanism for tracking the workout routine, as well as means for obtaining vital statistics of the user on the apparatus 10.

Figure 8:
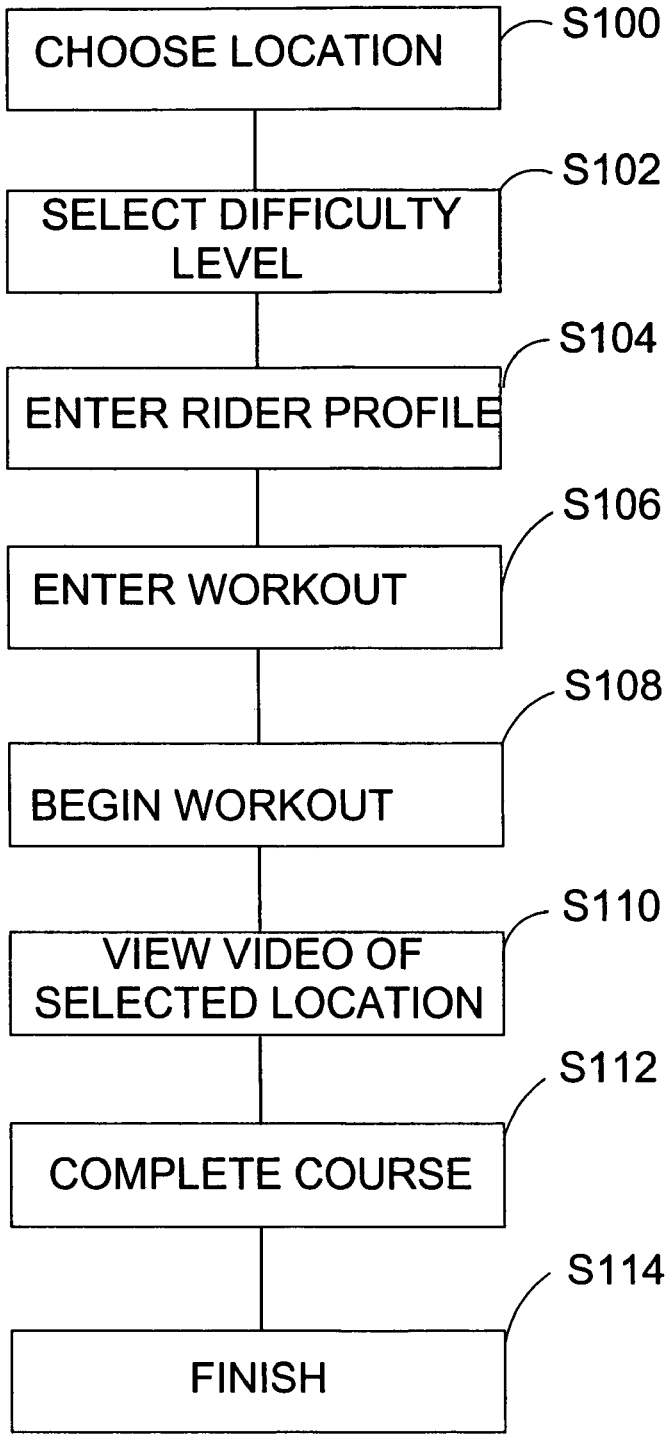
FIG. 8 is a flowchart detailing the operation of the video fitness apparatus of the present invention.

FIG. 8 is a flowchart detailing the operation of the video fitness apparatus of the present invention. As shown in step S100, the user, upon mounting the fitness apparatus 10 of the present invention chooses a location out of the pre-stored locations. The user, in step S102 is then able to select the difficulty level associated with the location selected in step S100. Thereafter, the user enters a user's profile as in step S104. The user's profile includes but is not limited to user's age and weight. After entering the profile, the user enters the desired format of the workout as in step S106 and begins the workout in step S108. While engaging in the cardiovascular workout in step S108, the user views the video of the selected location as in step S110. At the completion of the video the course is also completed as in step S112 and the user finishes the workout in step S114.

Figure 9:
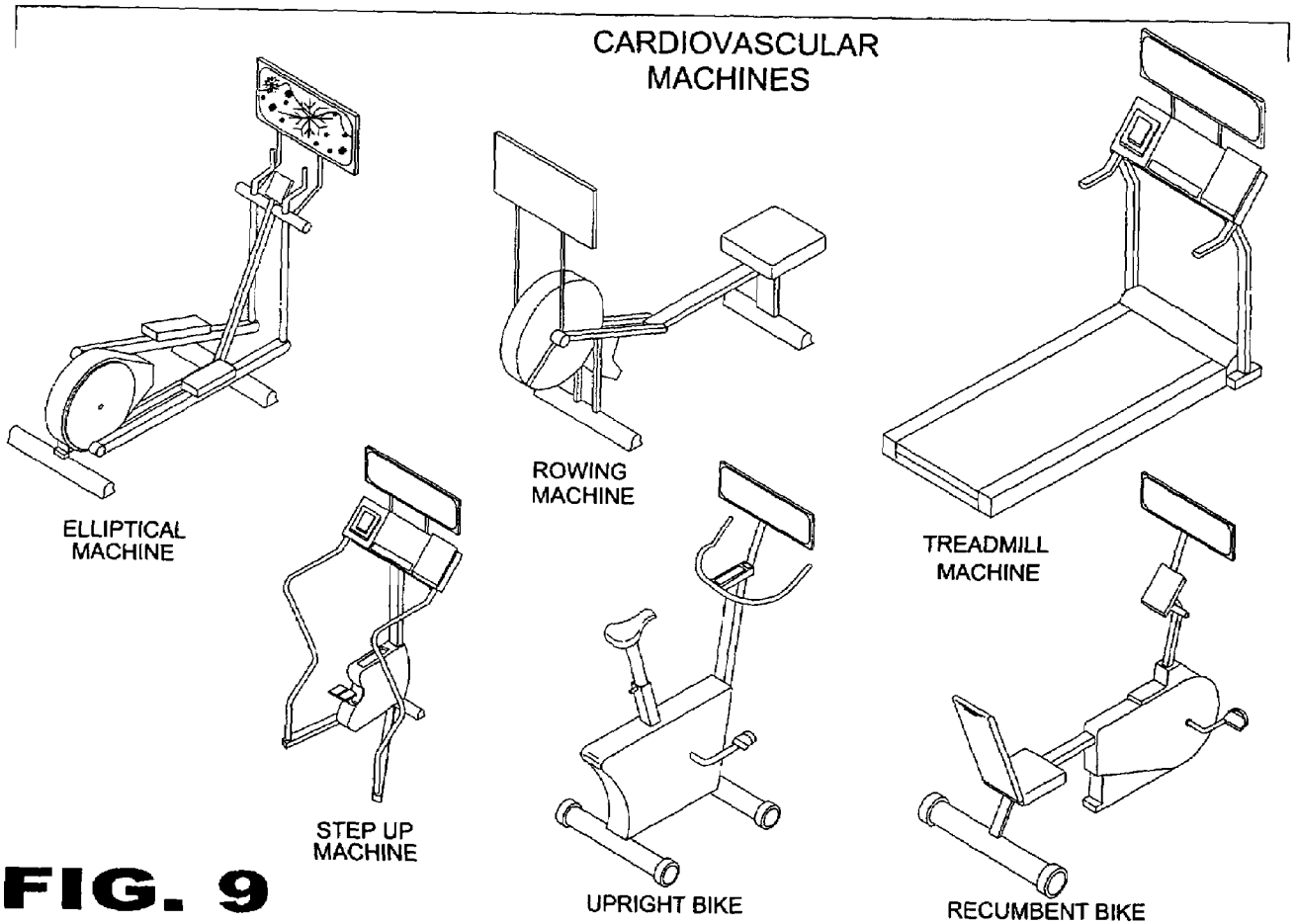
FIG. 9 is an illustrative view of various cardiovascular devices incorporating the video fitness apparatus of the present invention.

FIG. 9 is an illustrative view of various cardiovascular devices incorporating the video fitness apparatus of the present invention. As shown herein, the video fitness apparatus may be incorporated into any cardiovascular workout apparatus such as an elliptical machine, a rowing machine, a treadmill and a step machine, as well as an upright and recumbent bike which are discussed above with specific reference to FIGS. 1–8. As each of the additional fitness machines utilize a different activity, the video displayed by each respective device would be different. For example, if the present invention was formed as a rowing machine, video of a rowing canal would be displayed, whereas if the machine was a treadmill then video of a running course such as a marathon course would be displayed. Further, if the apparatus 10 is formed as a step machine, video of a climbing path would be displayed. These machines and respective videos displayed are described for purposes of example only and any video corresponding to the activity associated with each machine can be stored and displayed thereon.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A fitness apparatus comprising:

a) a stationary bicycle for providing a cardiovascular workout to a user, said bicycle having pedals;

b) a video display connected to said bicycle for displaying video data thereon and a moveable arm supporting said video display allowing said user to move the video display in a direction either towards or away from the user, said bicycle having a seat positioned on a first lower flat section and the video display extends up from a second higher flat section, with a handlebar positioned on an angled section connecting the lower and higher flat sections allowing the user sitting on said seat and holding onto said handlebar to be at substantially eye level with said vide display providing for a more realistic feeling when cycling and viewing the video data on said display;

c) a processor connected to said bicycle and said video display;

d) a storage device connected to said processor for storing video images of well known cycling courses around the world, wherein said processor retrieves said video data from said storage device about a selected cycling course and directs said video data to be displayed on said video display while the user uses the bicycle, said video display showing continuous moving video images of the course seen by the user as the user cycles through the course, said resistance data being derived from at least one of the change in topography, altitude, and pitch of a course stored in said storage device, said processor simultaneously reading resistance data stored in said storage device as the video data is displayed, the processor applying resistance data to a resistance control mechanism in said bicycle to selectively increase and decrease resistance applied to said pedals to accurately reflect the known topography of the cycling course being displayed for said user; and e) a ROM which includes a timing mechanism for tracking the workout routine and obtaining vital on said bicycle said ROM also including pre-programmed workout routines and instructions for operation of said resistance control mechanism.

2. The apparatus as recited in claim 1, wherein said resistance data and said video data follow a single timeline, wherein said processor interprets said resistance data while said video data is displayed on said video display as time increases at a predetermined increment from a zero point.

3. The apparatus as recited in claim 2, wherein said video display includes a monitor having a display screen.

4. The apparatus as recited in claim 3, where said display screen is at least one of a LCD display and a plasma display.

5. The apparatus as recited in claim 4, wherein said display is a touch-screen allowing the user to select on the touch-screen a workout routine or a cycling course stored in said storage device.

* * * * *